US010957991B2

(12) United States Patent
Xiao et al.

(10) Patent No.: US 10,957,991 B2
(45) Date of Patent: Mar. 23, 2021

(54) PLANAR ARRAY ANTENNA AND COMMUNICATIONS DEVICE

(71) Applicant: Huawei Technologies Co., Ltd., Shenzhen (CN)

(72) Inventors: Weihong Xiao, Shenzhen (CN); Naibiao Wang, Shenzhen (CN); Guoqing Xie, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 358 days.

(21) Appl. No.: 16/009,689

(22) Filed: Jun. 15, 2018

(65) Prior Publication Data

US 2018/0294578 A1 Oct. 11, 2018

Related U.S. Application Data

(63) Continuation of application No. PCT/CN2016/108950, filed on Dec. 7, 2016.

(30) Foreign Application Priority Data

Dec. 16, 2015 (CN) ..... 201521061945.0

(51) Int. Cl.

| | |
|---|---|
| ***H01Q 21/24*** | (2006.01) |
| ***H01Q 1/24*** | (2006.01) |
| ***H01Q 5/307*** | (2015.01) |

(52) U.S. Cl.

CPC ..... *H01Q 21/24* (2013.01); *H01Q 1/246* (2013.01); *H01Q 5/307* (2015.01)

(58) Field of Classification Search

CPC ..... H01G 21/24; H01G 5/307; H01G 1/246

See application file for complete search history.

(56) References Cited

U.S. PATENT DOCUMENTS

| | | | | |
|---|---|---|---|---|
| 6,333,720 | B1 | 12/2001 | Göttl et al. | |
| 2004/0108956 | A1 | 6/2004 | Gottl et al. | |
| 2009/0189821 | A1 | 7/2009 | Deng et al. | |
| 2011/0205119 | A1 | 8/2011 | Timofeev et al. | |
| 2014/0066757 | A1* | 3/2014 | Chayat ..... | H01Q 21/064 600/430 |
| 2015/0009078 | A1 | 1/2015 | Sun et al. | |
| 2015/0222025 | A1 | 8/2015 | Song et al. | |

FOREIGN PATENT DOCUMENTS

| | | | |
|---|---|---|---|
| CN | 103094715 | A | 5/2013 |
| CN | 103311651 | A | 9/2013 |
| CN | 103956587 | A | 7/2014 |
| CN | 104795635 | A | 7/2015 |
| CN | 205319307 | U | 6/2016 |
| WO | 2015117020 | A1 | 8/2015 |

* cited by examiner

*Primary Examiner* — Graham P Smith

(74) *Attorney, Agent, or Firm* — Slater Matsil, LLP

(57) ABSTRACT

Embodiments of this disclosure disclose a planar array antenna, including at least one first radiation array arranged along a first direction. The first radiation array includes at least one first radiation unit and at least one radiation unit pair, the first radiation unit and the radiation unit pair are disposed on an axis of the first radiation array, the radiation unit pair includes at least two second radiation units, and the at least two second radiation units are symmetric with respect to the axis of the first radiation array. In addition, the embodiments of this disclosure further disclose a communications device to which the planar array antenna is applied.

18 Claims, 6 Drawing Sheets

PLANAR ARRAY ANTENNA AND COMMUNICATIONS DEVICE

CROSS-REFERENCE TO RELATED APPLICATIONS

This application is a continuation of International Application No. PCT/CN2016/108950, filed on Dec. 7, 2016, which claims priority to Chinese Patent Application No. 201521061945.0, filed on Dec. 16, 2015. The disclosures of the aforementioned applications are hereby incorporated by reference in their entireties.

TECHNICAL FIELD

The embodiments of this disclosure relates to the field of communications technologies, and in particular, to a planar array antenna and a communications device to which the planar array antenna is applied.

BACKGROUND

An antenna is an indispensable part of a mobile communications device. During mobile communication, performance of a base station antenna directly affects a communication effect. With development of mobile communication, users have higher requirements on high-speed data transmission. In addition, requirement types of the users become increasingly diversified, and modern mobile communication is developing towards a multimode multiband direction. Mobile communications devices are updated at an increasingly faster speed. However, it becomes more difficult to obtain available urban site resources. A multimode multiband base station antenna provides a more effective means for site sharing during mobile communication, and satisfies a requirement of smooth upgrade of a device deployed on a live network and is environmentally-friendly and energy-saving. Therefore, the multimode multiband base station antenna is a direction of base station antenna development in the future. One multimode multiband base station antenna needs to include a plurality of antenna arrays that can work on a same frequency band or different frequency bands. However, limited mounting space and broadband work of the antenna array bring new challenges to antenna design.

To implement, in the limited mounting space, an electrical performance indicator of a multimode multiband antenna that satisfies the requirements, a solution in a current system is: implementing a dual-band array antenna by using a conventional two-column layout, that is, the dual-band array antenna includes two radiation arrays that are horizontally arranged, as shown in FIG. 1. However, the antenna has a relatively large horizontal width dimension and is not suitable for constructing a miniaturized multi-array antenna. If the horizontal width dimension of the antenna is reduced by reducing a distance between the radiation arrays, mutual coupling between the radiation arrays is increased, and there are problems that a horizontal beam width of the antenna is increased, a gain is reduced, or the like. Therefore, to reduce the horizontal beam width of the array antenna and increase the gain of the antenna, another solution in a current system is: implementing a dual-band array antenna by horizontally arranging one or more radiation units in a staggered manner, as shown in FIG. 2. However, although the horizontal width dimension of the antenna is relatively small by arranging one or more radiation units in a staggered manner, because the one or more radiation units deviate from an axis of the radiation array, the arrangement of the radiation units is asymmetric with respect to the axis of the radiation array, leading to anomalous asymmetric side lobes in a directivity pattern of the antenna and a reduced gain of the antenna.

SUMMARY

Embodiments of this disclosure provide a planar array antenna, to reduce a horizontal width dimension of an antenna, so that a directivity pattern of the antenna is horizontally symmetric, and a gain of the antenna is increased.

In addition, the embodiments of this disclosure further provide a communications device to which the planar array antenna is applied.

According to a first aspect, an embodiment of this disclosure provides a planar array antenna. The planar array antenna includes at least one first radiation array arranged along a first direction. The first radiation array includes at least one first radiation unit and at least one radiation unit pair. The first radiation unit and the radiation unit pair are disposed on an axis of the first radiation array. The radiation unit pair includes at least two second radiation units. The at least two second radiation units are symmetric with respect to the axis of the first radiation array.

In the planar array antenna, the radiation unit pair including at least two second radiation units are disposed in the first radiation array, and the at least two second radiation units are set to be symmetric with respect to the axis of the first radiation array, so that all radiation units (including the first radiation unit and the second radiation unit) in the first radiation array are symmetrically arranged with respect to the axis of the first radiation array. Therefore, the planar array antenna has a relatively small horizontal beam width, and has features of a horizontally symmetric directivity pattern and a high gain.

With reference to the first aspect, in a first possible implementation of the first aspect, the at least two second radiation units are arranged along a second direction, the second direction is perpendicular to the first direction, and the second direction and the first direction are in a same plane.

With reference to the first aspect, in a second possible implementation of the first aspect, the at least two second radiation units are arranged in a single column or in a matrix.

The second radiation units in the radiation unit pair may be arranged according to a space layout requirement and a gain requirement of the planar array antenna during actual application. On a premise that it is ensured that all of the second radiation units in the radiation unit pair are symmetric with respect to the axis of the first radiation array, the second radiation units may be arranged in a single-column horizontal arrangement manner or a matrix arrangement manner. For example, when a quantity of the second radiation units included in the radiation unit pair is greater than or equal to four, the matrix arrangement manner may be used, to reduce a horizontal width dimension of the planar array antenna.

With reference to the first aspect, in a third possible implementation of the first aspect, the planar array antenna further includes at least one second radiation array arranged along the first direction, the second radiation array and the first radiation array are arranged along a second direction at an interval, the second direction is perpendicular to the first direction, and the second direction and the first direction are in a same plane.

In the planar array antenna, because the second radiation units in the radiation unit pair are symmetric with respect to the axis of the first radiation array, the first radiation array has a relatively small horizontal beam width and a relatively high gain, and an operating band range of the planar array antenna can be increased by arranging the first radiation array including the radiation unit pair and the at least one second radiation array along the second direction at an interval, so that a multimode multiband planar array antenna can be formed.

With reference to the third possible implementation of the first aspect, in a fourth possible implementation of the first aspect, the second radiation array includes at least one first radiation unit, the first radiation unit is disposed on an axis of the second radiation array, and the first radiation unit in the second radiation array and the first radiation unit and the radiation unit pair in the adjacent first radiation array are arranged in a staggered manner.

The first radiation unit in the second radiation array and the first radiation unit and the radiation unit pair in the adjacent first radiation array are arranged in a staggered manner, so that a distance between the first radiation array and the second radiation array can be effectively reduced. In addition, interference between the first radiation unit and the radiation unit pair in the first radiation array and the first radiation unit in the second radiation array can be reduced, so that radiation performance of the planar array antenna is improved.

With reference to the fourth possible implementation of the first aspect, in a fifth possible implementation of the first aspect, the first radiation unit in each second radiation array is a dual-polarized radiation unit working on a same frequency band.

With reference to the first aspect, in a sixth possible implementation of the first aspect, the planar array antenna includes at least two adjacent first radiation arrays arranged along the first direction, and the first radiation units and the radiation unit pairs in two adjacent first radiation arrays are arranged in a staggered manner.

The radiation unit pair includes at least two second radiation units, so that a width of the radiation unit pair is greater than a width of a single first radiation unit. Therefore, a distance between the adjacent first radiation arrays can be reduced by arranging the radiation unit pairs in the two adjacent first radiation arrays in a staggered manner, thereby reducing a horizontal width dimension of the planar array antenna. In addition, interference between the first radiation units and the radiation unit pairs in the two adjacent first radiation arrays can be reduced by arranging the first radiation units in the two adjacent first radiation arrays in a staggered manner, and radiation performance of the planar array antenna is improved.

With reference to the sixth possible implementation of the first aspect, in a seventh possible implementation of the first aspect, each first radiation array includes a first end and a second end relative to each other, the first ends of the first radiation arrays are at a same side, the radiation unit pair in one of the two adjacent first radiation arrays is disposed at the first end of the one first radiation array, and the radiation unit pair in the other of the two adjacent first radiation arrays is disposed at the second end of the other first radiation array.

With reference to the first aspect, the first possible implementation of the first aspect, the second possible implementation of the first aspect, the third possible implementation of the first aspect, the fourth possible implementation of the first aspect, the fifth possible implementation of the first aspect, the sixth possible implementation of the first aspect, or the seventh possible implementation of the first aspect, in an eighth possible implementation of the first aspect, both the first radiation unit and the second radiation unit in each first radiation array are dual-polarized radiation units working on a same frequency band.

According to a second aspect, an embodiment of this disclosure provides a communications device. The communications device includes the planar array antenna according to the first aspect, the first possible implementation of the first aspect, the second possible implementation of the first aspect, the third possible implementation of the first aspect, the first possible implementation of the fourth aspect, the fifth possible implementation of the first aspect, the sixth possible implementation of the first aspect, the seventh possible implementation of the first aspect, or the eighth possible implementation of the first aspect.

According to the planar array antenna provided in the embodiments of this disclosure, the radiation unit pair is disposed in the first radiation array, and the second radiation units included in the radiation unit pair are symmetrical with respect to the axis of the first radiation array. Therefore, all of the radiation units in the first radiation array are symmetric with respect to the axis, so that the planar array antenna has a relatively small horizontal beam width, a symmetric horizontal directivity pattern, and a relatively high gain, and has a compact horizontal width dimension.

BRIEF DESCRIPTION OF THE DRAWINGS

To describe the technical solutions in the embodiments of this disclosure or in the prior art more clearly, the following briefly describes the accompanying drawings required for describing the embodiments or the prior art. Apparently, the accompanying drawings in the following description show merely some embodiments of the present invention, and a person of ordinary skill in the art may still derive other drawings from these accompanying drawings without creative efforts.

DETAILED DESCRIPTION OF ILLUSTRATIVE EMBODIMENTS

The following describes the technical solutions in the embodiments of this disclosure with reference to the accompanying drawings in the embodiments of this disclosure. Apparently, the described embodiments are merely some but not all of the embodiments of this disclosure. All other embodiments obtained by a person of ordinary skill in the art based on the embodiments of this disclosure without creative efforts shall fall within the protection scope of the present invention.

Embodiments of this disclosure provide a planar array antenna, applied to a wireless communications device such as a communications base station and configured to receive and transmit a wireless communication signal. The planar array antenna includes at least one first radiation array arranged along a first direction, the first radiation array includes at least one first radiation unit and at least one radiation unit pair, the first radiation unit and the radiation unit pair are disposed on an axis of the first radiation array, the radiation unit pair includes at least two second radiation units, and the at least two second radiation units are symmetric with respect to the axis of the first radiation array.

It can be understood that, a quantity of the first radiation arrays included in the planar array antenna, a quantity of the first radiation units and the radiation unit pairs included in the first radiation array, and a quantity of the second radiation units included in the radiation unit pair may be set according to a horizontal beam width, a vertical beam width, and a gain requirement of the planar array antenna during actual application. Therefore, the quantity of the first radiation arrays, the quantity of the first radiation units and the radiation unit pairs included in the first radiation array, and the quantity of the second radiation units included in the radiation unit pair in the embodiments of this disclosure are merely an example for describing a specific implementation solution of this disclosure, and do not constitute any limitation on a structure of the planar array antenna.

Figure 1:
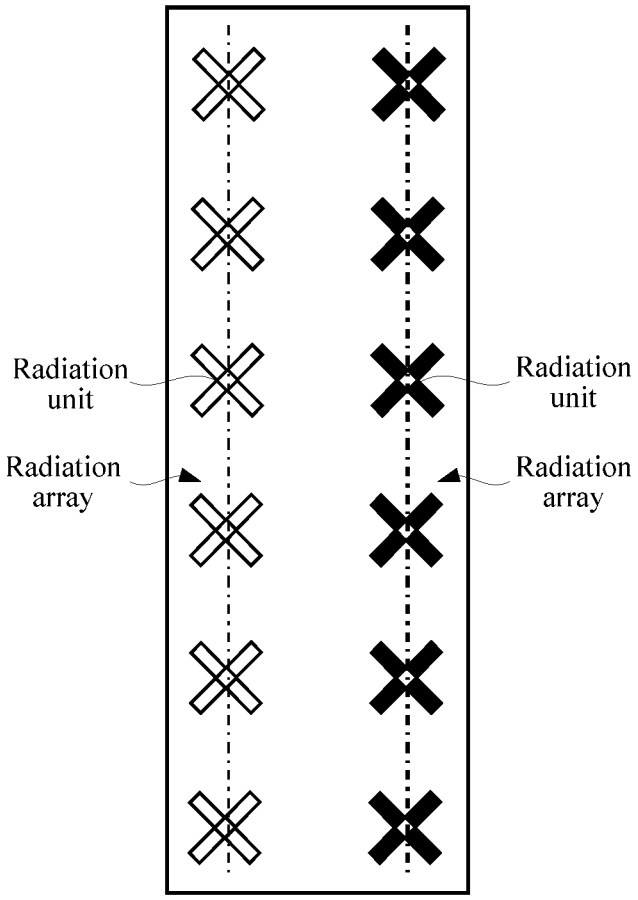
FIG. 1 is a schematic structural diagram of a planar array antenna in a current system.
Figure 2:
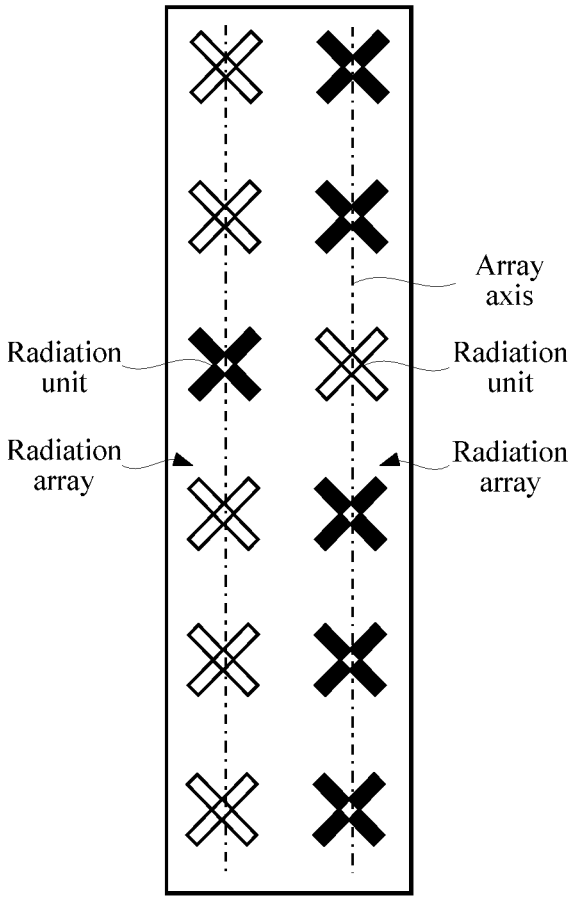
FIG. 2 is another schematic structural diagram of a planar array antenna in a current system.
Figure 3:
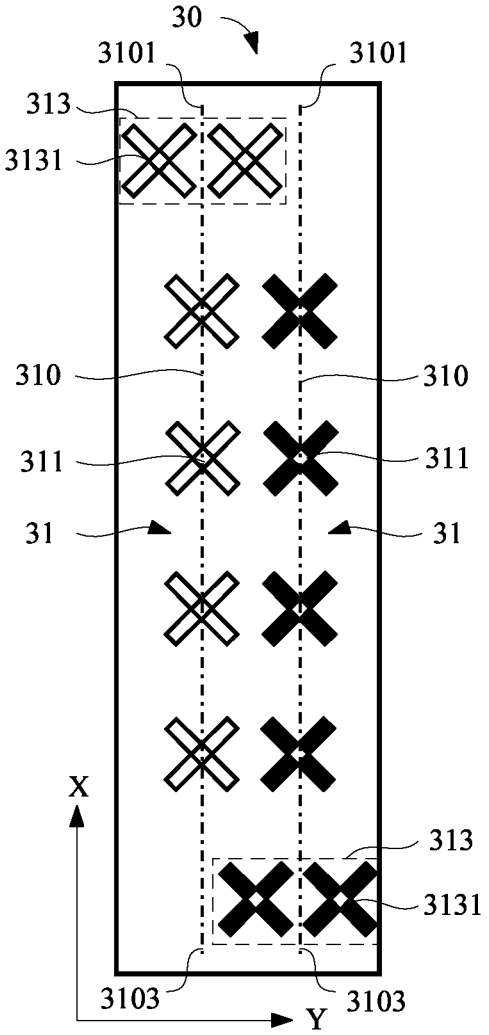
FIG. 3 is a schematic structural diagram of a planar array antenna according to a first embodiment of this disclosure.

FIG. 3 is a schematic structural diagram of a planar array antenna 30 according to a first embodiment of this disclosure. The planar array antenna 30 includes two first radiation arrays 31 arranged along a first direction X, the first radiation array 31 includes four first radiation units 311 and one radiation unit pair 313, the first radiation units 311 and the radiation unit pair 313 are disposed on an axis 310 of the first radiation array 31 along the first direction X, the radiation unit pair 313 includes two second radiation units 3131, the two second radiation units 3131 are arranged along a second direction Y, and the two second radiation units 3131 are symmetric with respect to the axis 310 of the first radiation array 31. The second direction Y is perpendicular to the first direction X, and the second direction Y and the first direction X are in a same plane. In this embodiment, the first direction X is a vertical direction, and the second direction Y is a horizontal direction.

In this embodiment, because the two first radiation arrays 31 that are arranged along the first direction X are adjacently arranged, the radiation unit pairs 313 in the two adjacent first radiation arrays 31 need to be arranged in a staggered manner. Specifically, each first radiation array 31 includes a first end 3101 and a second end 3103 relative to each other, and the first ends 3101 of the first radiation arrays 31 are at a same side. The radiation unit pair 313 in one of the two adjacent first radiation arrays 31 is disposed at the first end 3101 of the one first radiation array 31, and the radiation unit pair 313 in the other of the two adjacent first radiation arrays 31 is disposed at the second end 3103 of the other first radiation array 31, so that the radiation unit pairs 313 in the two adjacent first radiation arrays 31 are arranged in a staggered manner. Therefore, a horizontal width of the planar array antenna 30 can be reduced, and the planar array antenna 30 has a compact horizontal width dimension.

It can be understood that, both the first radiation unit 311 and the second radiation unit 3131 in each first radiation array 31 are dual-polarized radiation units working on a same frequency band, that is, each first radiation array 31 works on one frequency band, to receive and transmit a wireless communication signal on the one frequency band. During actual application, the two adjacent first radiation arrays 31 may work on different frequency bands, to implement a dual-band dual-mode array antenna.

In this embodiment, the radiation unit pair 313 is disposed in the first radiation array 31, and the second radiation units 3131 in the radiation unit pair 313 are symmetric with respect to the axis 310 of the first radiation array 31, so that all of the radiation units in the first radiation array 31 are symmetric with respect to the axis 310 of the first radiation array 31, the planar array antenna 30 has a relatively small horizontal beam width, a directivity pattern of each first radiation array 31 is horizontally symmetric, and the planar array antenna 30 has a relatively high gain.

Figure 4:
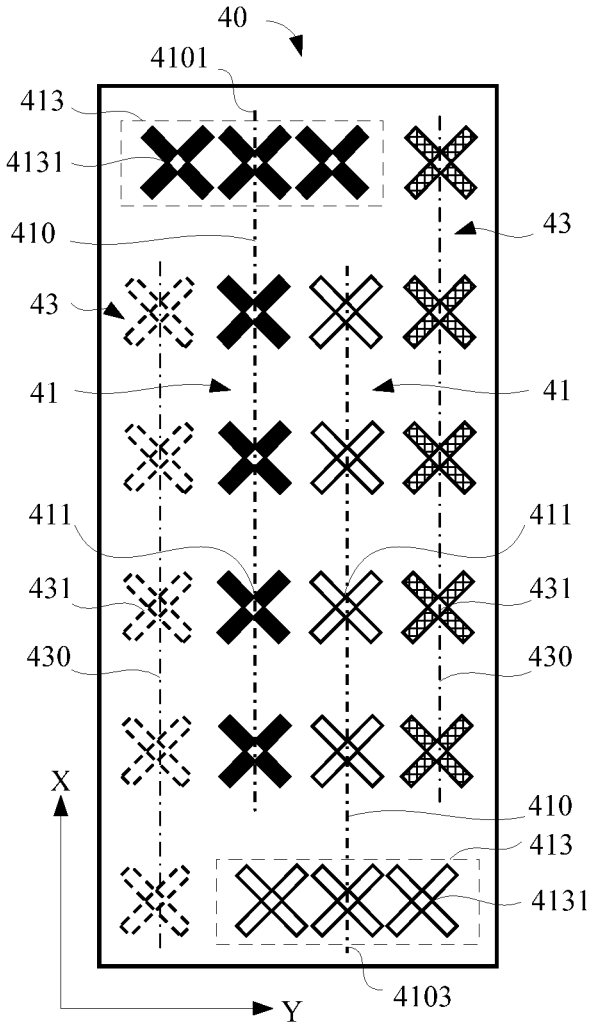
FIG. 4 is a schematic structural diagram of a planar array antenna according to a second embodiment of this disclosure.

FIG. 4 is a schematic structural diagram of a planar array antenna 40 according to a second embodiment of this disclosure. The planar array antenna 40 includes two first radiation arrays 41 and two second radiation arrays 43 arranged along a first direction X, the two first radiation arrays 41 are arranged along a second direction Y at an interval, and the two second radiation arrays 43 are respectively arranged at two sides of the two first radiation arrays 41 along the second direction Y. Each first radiation array 41 includes four first radiation units 411 and one radiation unit pair 413, and the first radiation units 411 and the radiation unit pair 413 are disposed on an axis 410 of the first radiation array 41 along the first direction X. The radiation unit pair 413 includes three second radiation units 4131, the three second radiation units 4131 are arranged along the second direction Y, and the three second radiation units 4131 are symmetric with respect to the axis 410 of the first radiation array 41. The second direction Y is perpendicular to the first direction X, and the second direction Y and the first direction X are in a same plane. In this embodiment, the first direction X is a vertical direction, and the second direction Y is a horizontal direction.

Each second radiation array 43 includes five first radiation units 431, and the five first radiation units 431 are disposed on an axis 430 of the second radiation array 43. Each first radiation unit 431 in the second radiation array 43 is horizontally aligned with one first radiation unit 411 or one second radiation unit 4131 in the first radiation array 41. It can be understood that, during actual application, the first radiation unit 431 in the second radiation array 43 and the first radiation unit 411 and the radiation unit pair 413 in the adjacent first radiation array 41 may be arranged in a staggered manner, to reduce a horizontal width of the planar array antenna 40.

In the radiation unit pair 413 in each first radiation array 41, one of the three second radiation units 4131 is disposed on the axis 410 of the first radiation array 41, and the other two second radiation units 4131 are respectively disposed horizontally at two sides of the second radiation unit 4131 on the axis 410 and are symmetric with respect to the axis 410, so that all of the radiation units in each first radiation array 41 are symmetric with respect to the axis 410, the planar array antenna 40 has a relatively small horizontal beam width, a directivity pattern of each first radiation array 41 is horizontally symmetric, and the planar array antenna 40 has a relatively high gain. It can be understood that, a distance between the second radiation units 4131 in each radiation unit pair 413 may be set according to a size requirement of the planar array antenna 40, and is not limited to a distance shown in FIG. 4 in this embodiment.

It can be understood that, the radiation unit pairs 413 in two adjacent first radiation arrays 41 need to be arranged in a staggered manner, to reduce the horizontal width of the planar array antenna 40. In this embodiment, each first radiation array 41 includes a first end 4101 and a second end 4103 relative to each other, and the first ends 4101 of the first radiation arrays 41 are at a same side. The radiation unit pair 413 in one of the two first radiation arrays 41 is disposed at the first end 4101, and the radiation unit pair 413 in the other first radiation array 41 is disposed at the second end 4103, so that the radiation unit pairs 413 in the two adjacent first radiation arrays 41 are arranged in a staggered manner.

In this embodiment, both the first radiation unit 411 and the second radiation unit 4131 in each first radiation array 41 are dual-polarized radiation units working on a same frequency band, and all of the first radiation units 431 in each second radiation array 43 are dual-polarized radiation units working on a same frequency band. During actual application, each first radiation array 41 may work on one frequency band, and each second radiation array 43 may work on one frequency band, to implement a multimode multiband array antenna.

Figure 5:
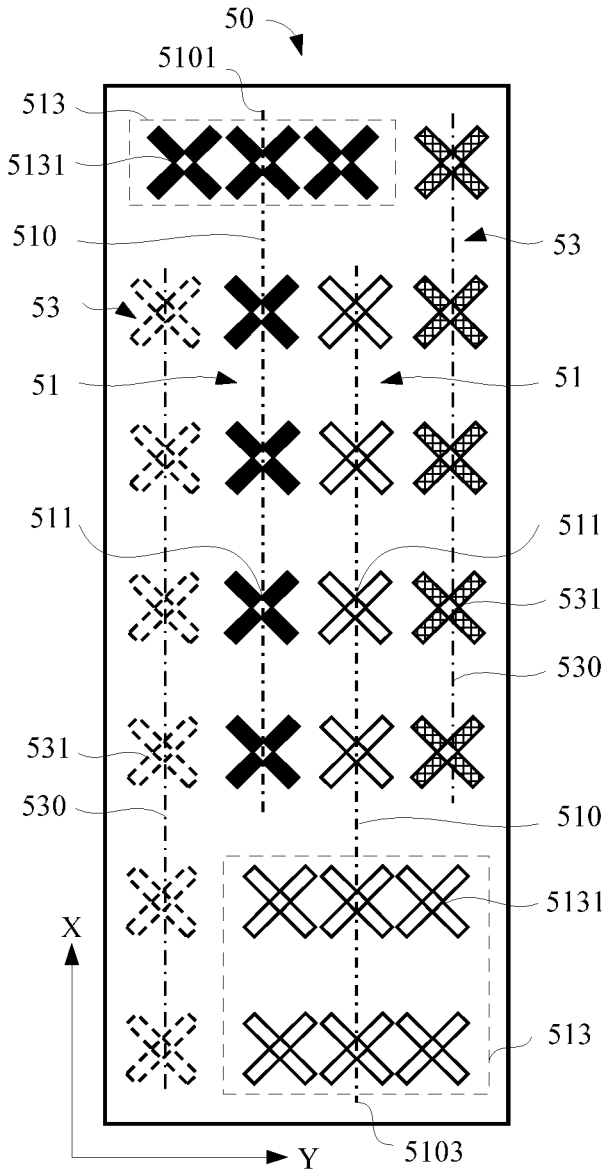
FIG. 5 is a schematic structural diagram of a planar array antenna according to a third embodiment of this disclosure.

FIG. 5 is a schematic structural diagram of a planar array antenna 50 according to a third embodiment of this disclosure. The planar array antenna 50 includes two first radiation arrays 51 and two second radiation arrays 53 arranged along a first direction X, the two first radiation arrays 51 are arranged along a second direction Y at an interval, and the two second radiation arrays 53 are respectively arranged at two sides of the two first radiation arrays 51 along the second direction Y. Each first radiation array 51 includes four first radiation units 511 and one radiation unit pair 513, and the first radiation units 511 and the radiation unit pair 513 are disposed on an axis 510 of the first radiation array 51 along the first direction X. The radiation unit pair 513 in one of the two first radiation arrays 51 includes three second radiation units 5131, the three second radiation units 5131 are arranged along the second direction Y, and the three second radiation units 5131 are symmetric with respect to the axis 510 of the first radiation array 51. A specific arrangement manner is the same as that in the embodiment shown in FIG. 4, and details are not described herein again. The radiation unit pair 513 in the other of the two first radiation arrays 51 includes six second radiation units 5131, and the six second radiation units 5131 are arranged in a matrix and are symmetric with respect to the axis 510 of the first radiation array 51. The second direction Y is perpendicular to the first direction X, and the second direction Y and the first direction X are in a same plane. In this embodiment, the first direction X is a vertical direction, and the second direction Y is a horizontal direction.

One of the two second radiation arrays 53 includes six first radiation units 531, and the first radiation units 531 are disposed on an axis 530 of the second radiation array 53. The other of the two second radiation arrays 53 includes five first radiation units 531, and the first radiation units 531 are disposed on an axis 530 of the second radiation array 53. Each first radiation unit 531 in the second radiation array 53 is horizontally aligned with one first radiation unit 511 or one second radiation unit 5131 in the first radiation array 51. It can be understood that, during actual application, the first radiation unit 531 in the second radiation array 53 and the first radiation unit 511 and the radiation unit pair 513 in the adjacent first radiation array 51 may be arranged in a staggered manner, to reduce a horizontal width of the planar array antenna 50.

In this embodiment, when the radiation unit pair 513 includes six second radiation units 5131, two of the six second radiation units 5131 are disposed on the axis 510 at an interval, two of the other four second radiation units 5131 are respectively disposed horizontally on two sides of one second radiation unit 5131 on the axis 510, the other two of the other four second radiation units 5131 are respectively disposed horizontally on two sides of the other second radiation unit 5131 on the axis 510, and each two of the other four second radiation units 5131 are vertically aligned and each two of the other four second radiation units 5131 are horizontally symmetric with respect to the axis 510. It can be understood that, when a quantity of the second radiation units 5131 included in the radiation unit pair 513 is an even number, the even-numbered second radiation units 5131 may be arranged in a matrix.

It can be understood that, the radiation unit pairs 513 in two adjacent first radiation arrays 51 need to be arranged in a staggered manner, to reduce the horizontal width of the planar array antenna 50. In this embodiment, each first radiation array 51 includes a first end 5101 and a second end 5103 relative to each other, and the first ends 5101 of the first radiation arrays 51 are at a same side. The radiation unit pair 513 in one of the two first radiation arrays 51 is disposed at the first end 5101, and the radiation unit pair 513 in the other first radiation array 51 is disposed at the second end 5103, so that the radiation unit pairs 513 in the two adjacent first radiation arrays 51 are arranged in a staggered manner.

In this embodiment, both the first radiation unit 511 and the second radiation unit 5131 in each first radiation array 51 are dual-polarized radiation units working on a same frequency band, and all of the first radiation units 531 in each second radiation array 53 are dual-polarized radiation units working on a same frequency band. During actual application, each first radiation array 51 may work on one frequency band, and each second radiation array 53 may work on one frequency band, to implement a multimode multiband array antenna.

Figure 6:
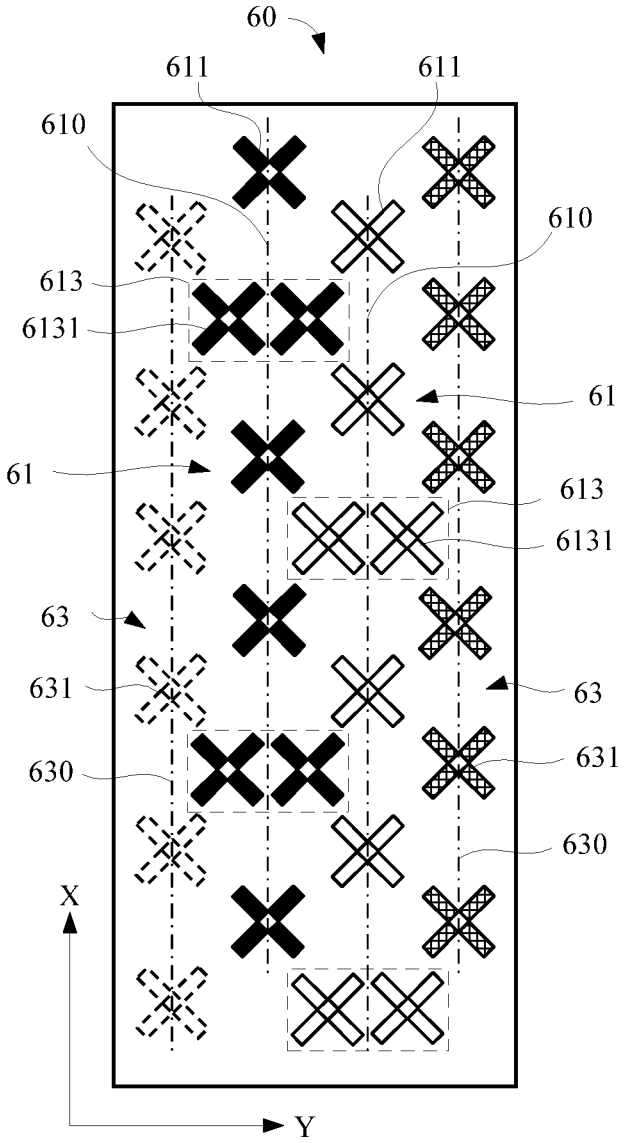
FIG. 6 is a schematic structural diagram of a planar array antenna according to a fourth embodiment of this disclosure.

Referring to FIG. 6, FIG. 6 is a schematic structural diagram of a planar array antenna 60 according to a fourth embodiment of this disclosure. The planar array antenna 60 includes two first radiation arrays 61 and two second radiation arrays 63 arranged along a first direction X, the two first radiation arrays 61 are arranged along a second direction Y at an interval, and the two second radiation arrays 63 are respectively arranged at two sides of the two first radiation arrays 61 along the second direction Y. Each first radiation array 61 includes four first radiation units 611 and two radiation unit pairs 613, the first radiation units 611 and the radiation unit pairs 613 are disposed on an axis 610 of the first radiation array 61 along the first direction X, the radiation unit pair 613 includes two second radiation units 6131, the two second radiation units 6131 are arranged along the second direction Y, and the two second radiation units 6131 are symmetric with respect to the axis 610 of the first radiation array 61. The first radiation units 611 and the radiation unit pairs 613 in the two first radiation arrays 61 are arranged on the second direction Y in a staggered manner. Each second radiation array 63 includes six first radiation units 631, and the first radiation units 631 are disposed on an axis 630 of the second radiation array 63. The first radiation unit 631 in each second radiation array 63 and the first radiation unit 611 and the radiation unit pair 613 in the adjacent first radiation array 61 are arranged along the second direction Y in a staggered manner. The second direction Y is perpendicular to the first direction X, and the second direction Y and the first direction X are in a same plane. In this embodiment, the first direction X is a vertical direction, and the second direction Y is a horizontal direction.

In this embodiment, the first radiation units 611 and the radiation unit pairs 613 in the adjacent first radiation arrays 61 are arranged in a staggered manner, and the first radiation unit 631 in the second radiation array 63 adjacent to the first radiation array 61 and the first radiation unit 611 and the radiation unit pair 613 are arranged in a staggered manner, so that a distance between the adjacent first radiation arrays 61 and a distance between the first radiation array 61 and the adjacent second radiation array 63 can be effectively reduced. Therefore, the planar array antenna 60 has a compact horizontal width dimension. In addition, the first radiation units 611 and the radiation unit pairs 613 in the adjacent first radiation arrays 61 are arranged in a staggered manner, and the first radiation unit 631 in the second radiation array 63 adjacent to the first radiation array 61 and the first radiation unit 611 and the radiation unit pair 613 are arranged in a staggered manner, interference between the first radiation units 611 and the radiation unit pairs 613 in the adjacent first radiation arrays 61 can be reduced, and interference between the first radiation units 611 and the radiation unit pairs 613 in the first radiation arrays 61 and the first radiation units 631 in the second radiation array 63 is reduced, so that radiation performance of the planar array antenna 60 is improved.

In addition, an embodiment of this disclosure further provides a communications device, including a planar array antenna, and the planar array antenna is configured to receive and transmit a wireless communication signal. The communications device may be a base station, and the planar array antenna may be the planar array antenna described in any embodiment shown in FIG. 3 to FIG. 6. Specifically, refer to the related descriptions in the embodiments in FIG. 3 to FIG. 6, and details are not described herein again.

According to the planar array antenna provided in the embodiments of this disclosure, the radiation unit pair is disposed in the first radiation array, and the second radiation units included in the radiation unit pair are symmetrical with respect to the axis of the first radiation array. Therefore, all of the radiation units in the first radiation array are symmetric with respect to the axis, so that the planar array antenna has a relatively small horizontal beam width, a symmetric horizontal directivity pattern, and a relatively high gain. In addition, the first radiation array is disposed in the planar array antenna, so that the planar array antenna has a compact horizontal width dimension, and design and mounting of a multimode multiband array antenna can be implemented in limited space.

What is disclosed above is merely an example of embodiments of this disclosure, and certainly is not intended to limit the protection scope of this disclosure. A person of ordinary skill in the art may understand that all or some of processes that implement the foregoing embodiments and equivalent modifications made in accordance with the claims of this disclosure shall fall within the scope of this disclosure.

What is claimed is:

1. A planar array antenna, comprising:

a first radiation array arranged along a first axis that extends in a first direction, the first radiation array comprising a first radiation unit and a first radiation unit pair, wherein the first radiation unit and the first radiation unit pair are separately disposed along the first axis, the first radiation unit pair comprises a plurality of second radiation units, and the plurality of second radiation units is positioned in a manner that radiation units of the plurality of second radiation units are symmetric with respect to the first axis; and a second radiation array adjacent to the first radiation array and arranged along a second axis that extends in a second direction that is parallel to the first direction, the second radiation array comprising a third radiation unit and a second radiation unit pair, and the first radiation unit pair and the second radiation unit pair being arranged in a staggered manner; and wherein the first radiation array comprises a first end and a second end, the second radiation array comprises a first end and a second end, the first end of the first radiation array is a same side as the first end of the second radiation array, the second end of the first radiation array is a same side as the second end of the second radiation array, the first radiation unit pair is disposed at the first end of the first radiation array, and the second radiation unit pair is disposed at the second end of the second radiation array.

2. The planar array antenna according to claim 1, wherein the plurality of second radiation units is arranged along a third direction, the third direction is perpendicular to the first direction, and the third direction and the first direction are in a same plane.

3. The planar array antenna according to claim 1, wherein the plurality of second radiation units is arranged in a single column.

4. The planar array antenna according to claim 1, wherein the plurality of second radiation units is arranged in a matrix.

5. The planar array antenna according to claim 1, wherein the second radiation array and the first radiation array are arranged next to each other in a third direction, the first radiation array and the second radiation array are separated from each other in the third direction by an interval, the third direction is perpendicular to the first direction, and the third direction and the first direction are in a same plane.

6. The planar array antenna according to claim 5, wherein the third radiation unit is disposed on the second axis, and the third radiation unit, the first radiation unit, and the first radiation unit pair are arranged in a staggered manner.

7. The planar array antenna according to claim 6, wherein the first radiation unit and the third radiation unit are dual-polarized radiation units working on a same frequency band.

8. The planar array antenna according to claim 1, wherein the second radiation unit pair comprises a plurality of fourth radiation units, and wherein the first radiation unit, the third radiation unit, the first radiation unit pair, and the second radiation unit pair are arranged in a staggered manner.

9. The planar array antenna according to claim 1, wherein the first radiation unit and the plurality of second radiation units are dual-polarized radiation units working on a same frequency band.

10. A communications device, comprising:

a planar array antenna, wherein the planar array antenna comprises:

a first radiation array arranged along a first axis that extends in a first direction, the first radiation array comprising a first radiation unit and a first radiation unit pair, wherein the first radiation unit and the first radiation unit pair are separately disposed along the first axis, the first radiation unit pair comprises a plurality of second radiation units, and the plurality of second radiation units is positioned in a manner that the radiation units of the plurality of second radiation units are symmetric with respect to the first axis; and a second radiation array adjacent to the first radiation array and arranged along a second axis that extends in a second direction that is parallel to the first direction, the second radiation array comprising a third radiation unit and a second radiation unit pair, and the first radiation unit pair and the second radiation unit pair being arranged in a staggered manner; and wherein the first radiation array comprises a first end and a second end, the second radiation array comprises a first end and a second end, the first end of the first radiation array is a same side as the first end of the second radiation array, the second end of the first radiation array is a same side as the second end of the second radiation array, the first radiation unit pair is disposed at the first end of the first radiation array, and the second radiation unit pair is disposed at the second end of the second radiation array.

11. The communications device according to claim 10, wherein the plurality of second radiation units is arranged along a third direction, the third direction is perpendicular to the first direction, and the second direction and the first direction are in a same plane.

12. The communications device according to claim 10, wherein the plurality of second radiation units is arranged in a single column.

13. The communications device according to claim 10, wherein the plurality of second radiation units is arranged in a matrix.

14. The communications device according to claim 10, wherein the second radiation array and the first radiation array are arranged next to each other in a third direction, the second radiation array and the first radiation array are separated from each other in the third direction by an interval, the third direction is perpendicular to the first direction, and the second third direction and the first direction are in a same plane.

15. The communications device according to claim 14, wherein, the third radiation unit is disposed on the second axis, and the first radiation unit, the third radiation unit, and the first radiation unit pair are arranged in a staggered manner.

16. The communications device according to claim 15, wherein the first radiation unit and the third radiation unit are each dual-polarized radiation units working on a same frequency band.

17. The communications device according to claim 10, wherein the second radiation unit pair comprises a plurality of fourth radiation units, and wherein the first radiation unit, the third radiation unit, the first radiation unit pair, and the second radiation unit pair are arranged in a staggered manner.

18. The communications device according to claim 10, wherein the first radiation unit and the plurality of second radiation units are dual-polarized radiation units working on a same frequency band.

* * * * *